US005083692A

United States Patent [19]

Treese

[11] Patent Number: 5,083,692

[45] Date of Patent: Jan. 28, 1992

[54] STRAP AND CARRY SYSTEM

[75] Inventor: Gregory A. Treese, 13123 Greensmount Ave., Beltsville, Md. 20705

[73] Assignee: Gregory A. Treese, Beltsville, Md.

[21] Appl. No.: 636,700

[22] Filed: Jan. 2, 1991

Related U.S. Application Data

[63] Continuation-in-part of Ser. No. 329,184, Mar. 27, 1989, abandoned.

[51] Int. Cl.[5] ..... A45F 3/02

[52] U.S. Cl. ..... 224/205; 224/250; 224/258

[58] Field of Search ..... 224/150, 151, 202, 205, 224/250, 257, 258, 268, 269, 917; 294/146, 147, 149, 150, 157

[56] References Cited

U.S. PATENT DOCUMENTS

| | | | |
|---|---|---|---|
| 738,462 | 9/1903 | Lincoln | 294/149 |
| 3,377,007 | 4/1968 | Gayler | 294/197 |
| 3,865,292 | 2/1975 | Foley | 294/149 |
| 3,933,287 | 1/1976 | Foley | 294/149 |
| 4,127,223 | 11/1978 | Uchin | 294/150 |
| 4,887,752 | 12/1989 | Nauta | 224/202 |

FOREIGN PATENT DOCUMENTS

| | | | |
|---|---|---|---|
| 2490597 | 3/1982 | France | 224/917 |
| 2493117 | 5/1982 | France | 294/157 |
| 8501194 | 3/1985 | PCT Int'l Appl. | 224/917 |
| 8707170 | 12/1987 | PCT Int'l Appl. | 224/257 |

*Primary Examiner*—Henry J. Recla
*Assistant Examiner*—Glenn T. Barrett

[57] ABSTRACT

A strap and carry system for cradling and transporting flat and generally rectangular objects such as a body board. The system comprises three flexible loose straps secured to each other forming an adjustable flexible cradle which can be folded for storage and held open with one hand so that an object such as a body board can be inserted and secured for carrying.

8 Claims, 2 Drawing Sheets

STRAP AND CARRY SYSTEM

This application is a continuation-in-part of application Ser. No. 07/329,184, filed Mar. 27, 1989, now abandoned.

BACKGROUND OF THE INVENTION

This invention relates to a strap assembly for carrying objects associated with water and beach environments such as skimmer boards, body boards, surf boards, surf boards, beach chairs and coolers.

The shape of these objects can make transportation to and from the beach awkward when carrying these objects by hand. In most cases, the user is forced to carry these items on the top of the user's head, tucked under an arm or held in a hand at a user's side. This makes the carrying of additional objects difficult.

SUMMARY OF THE INVENTION

Accordingly, one object of the present invention is to provide a strap system for carrying objects associated with water and beach environments, such as those identified previously.

Another object of the present invention is to provide a strap system for carrying objects that does not require the wearer to use his or her hands while transporting objects, thus freeing the hands for other purposes.

Another object of the present invention is to provide a strap and carry system that is both flexible and adjustable.

Another object of the present invention is to provide a strap and carry system that permits easy insertion of the object into the strap and carry system.

Another object of the present invention is to provide a strap and carry system that can be folded to approximately pocket size when not in use for easy storage.

Another object of the present invention is to provide a strap and carry system that permits a stored wet object to be open to the air for drying.

Another object of the present invention is to provide a strap and carry system that is easily removable.

To accomplish the foregoing and other objects of this invention, the strap and carry system generally comprises three straps formed from plastic webbing. The first strap includes an adjustable, detachable fastening assembly for securing the two ends of the first strap together. The second strap includes an end portion secured to the first strap and an adjustable, detachable fastening assembly for securing the other end of the strap to an end of the third strap. The third strap is then secured to the first strap at a point diametrically opposite the point where the second strap is secured.

BRIEF DESCRIPTION OF THE DRAWINGS

The foregoing and other objects of the invention will be understood more fully from the following further description thereof, with reference to the accompanying drawings wherein.

DESCRIPTION OF THE PREFERRED EMBODIMENTS

Figure 1:
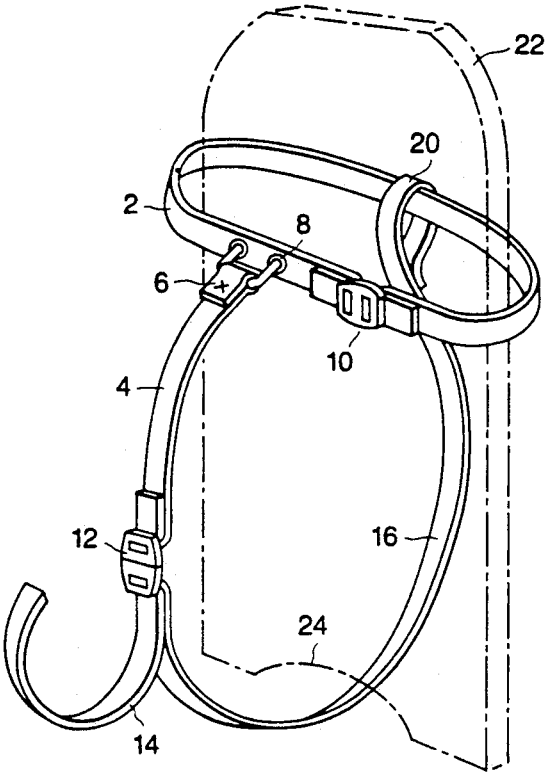
FIG. 1 is a perspective view of the strap and carry system according to one form of this invention, in association with a body board.

FIG. 1 shows the strap and carry system on a body board 22. The strap and carry system comprises a horizontal strap 2 which adjusts to various lengths with an adjustable buckle 10. The strap 2 can then hold body board 22 without damaging the board. A flexible rope ring 8 is secured to the horizontal strap through two metal grommets. A vertical front shoulder strap 4 is secured to the flexible ring 8 at connection 6. The front strap 4 is affixed to a back strap 16 with an adjustable buckle assembly 12. The back strap passes through the indent portion 24 of the body board 22 and is connected to the horizontal strap 2 at a point diametrically opposite the flexibe rope ring 8. A loop strap 20 of the back strap 16 connects the back strap to the horizontal strap 2. The loop strap is affixed to the horizontal strap using stitching, hook and loop fasteners or as flexible rope ring. The loop strap 20 forms a handle and can serve to attach other objects, such as surf fins, wet suits or other related items, to the strap and carry system. The back strap 16 can also be directly fastened to the horizontal strap 2 using stitching or a flexible rope ring. Extra long strap material 14 provided after adjustment of buckle 12 can be used to carry the body board 22 by hand. In its preferred form, the strap and carry system is constructed from soft nylon webbing which is ½ to 2 inches in width.

Figure 2:
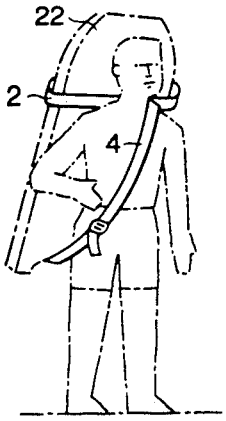
FIG. 2 is a frontal perspective view of the strap and carry system of FIG. 1 in use.
Figure 3:
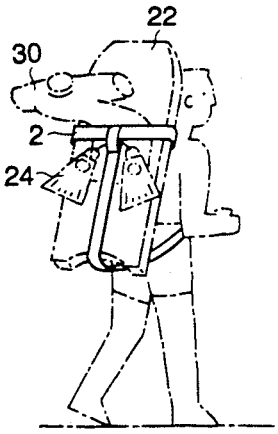
FIG. 3 is a rear perspective view of the strap and carry system of FIG. 1 in use.

Once the body board 22 and other objects such as wet suit 30 and surf fins 24 have been secured to the strap and carry system, the front vertical strap 4 is passed over the shoulder of the user and is oriented on the user's body as illustrated in FIGS. 2 and 3.

Figure 4:
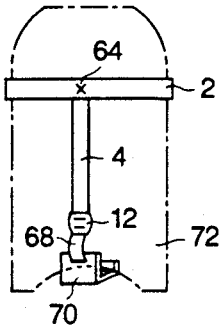
FIGS. 4 and 5 are alternative embodiments of the invention.

In FIG. 4 another embodiment of the invention is illustrated. Front vertical strap 4 is secured to horizontal strap 2 via stitching 64. The front strap 4 is connected to an adjustable buckle 12 which is affixed to a short strap 68. The short strap 68 is attached to a plastic or metal C-clamp 70 which slips under and holds up board 22. C-clamp 70 may be padded to prevent damage to the board.

Figure 5:
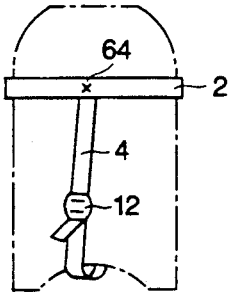

In FIG. 5 another embodiment of the invention is illustrated. Front vertical strap 4 is secured to horizontal strap 2 via stitching 64. There is no extra long strap material provided after adjustment of buckle 12 and no loop strap 20 is provided.

Figure 6:
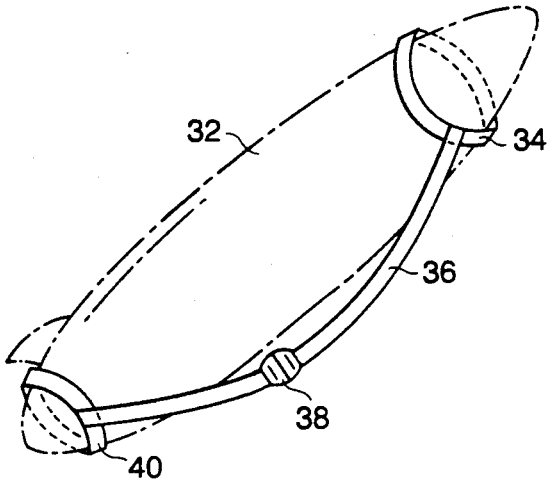
FIG. 6 is a perspective view of another embodiment of the invention, in association with a surf board.

In FIG. 6 another embodiment of the invention is illustrated for use with a surfboard 32 or any other similar item. The strap and carry system comprises a nose strap 34 attached to a long strap 36 having an adjustable buckle 38. The long strap 36 is also affixed to a tail fin strap 40.

Figure 7:
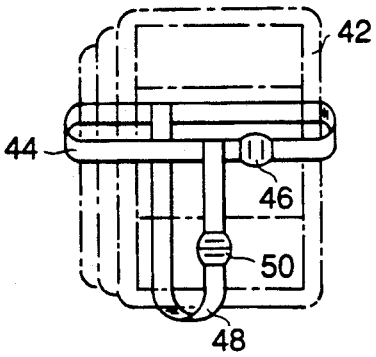
FIG. 7 shows a variant of the embodiment in FIG. 1, in association with a folding beach chair.

In FIG. 7, a strap and carry system is illustrated in use with a set of folding beach chairs 42. Horizontal strap 44 wraps around and holds the chairs together. The strap 44 is adjusted using adjustable buckle 46. A vertical strap 48 is secured to the horizontal strap 44 and includes an adjustable buckle assembly 50. The vertical strap 48 provides a cradle for the chairs 42. Strap 48 is placed over the shoulder of a user to secure the device in place.

Figure 8:
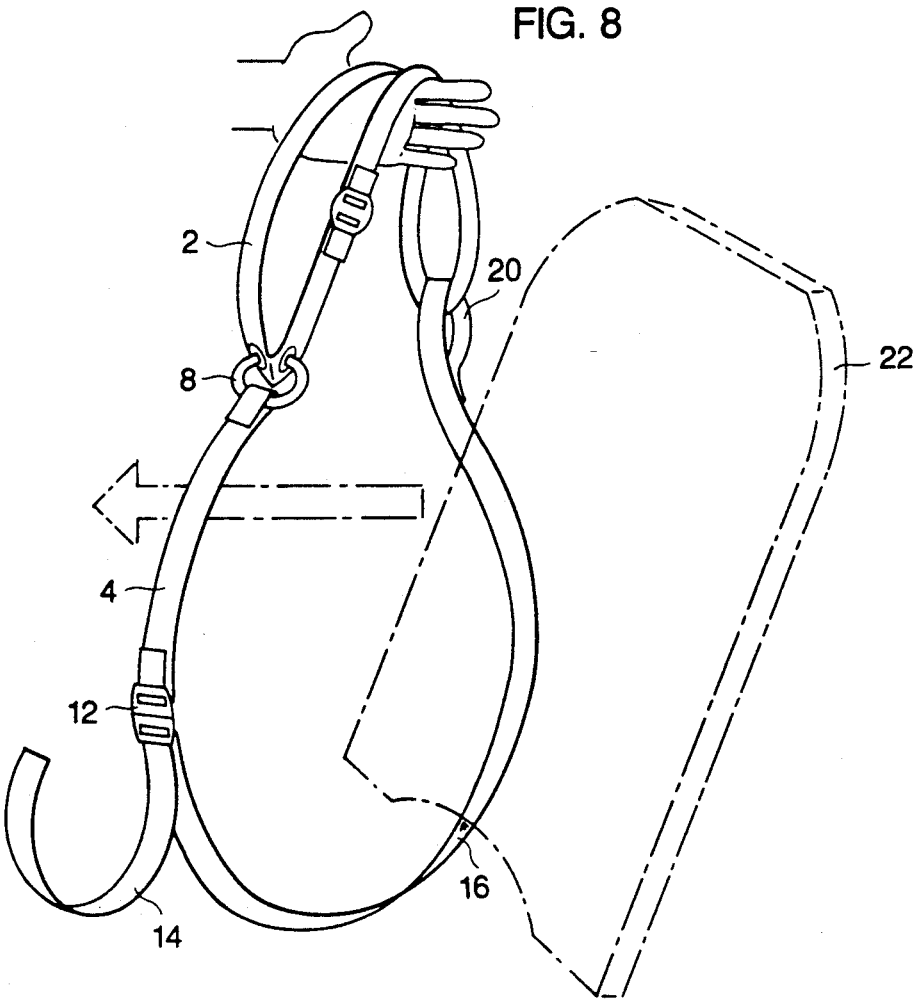
FIG. 8 is a perspective view of the strap and carry system according to FIG. 1 showing how the body board is inserted.

In FIG. 8, the strap and carry system of FIG. 1 is shown in a position to facilitate loading of the board into the system. In operation, the user grasps the horizontal strap 2 such that the rope ring 8 permits the strap 2 to fold. A vertical passageway is formed by the grasped strap 2 and the depending vertical straps 4 and 16 such that the body board 22 can be inserted. Vertical strap 16 contacts the undersurface 24 of the board 22. The horizontal strap 2 can then be returned to its normal position whereby adjustable buckles 10, 12 can be tightened and strap 4 can then be placed over the shoulder.

It should be understood that the foregoing description of the invention is intended merely to be illustrative thereof and that other modifications and embodiments may be apparent to those skilled in the art without departing from its spirit.

Having thus described the invention what I desire to claim and secure by Letters Patent is:

1. A strap and carry system for cradling and transporting an object having a longitudinal axis such as a body board comprising: a first strap, a second strap and a third strap;

said first strap having a first adjustable detachable fastening means secured to one end which intermittently fastens to an opposite end of said first strap; thereby forming one continuous, flexible loop which may be adjusted to have a larger or smaller diameter to loosely envelop and laterally extend around said body board;

said second strap having a loop at one end to form a handle through which said first strap passes and is fixed thereto at a point thereon;

and a second adjustable detachable fastening means secured to an opposite end of second strap and to a corresponding end of said third strap forming essentially one strap which may be adjustable in length to loosely envelop and position along the longitudinal axis of said board:

a ring secured to an opposite end of said third strap, said ring being secured to said first strap at a point diametrically opposite said handle so as to produce a flexible loose cradle;

wherein said ring serves as an axis providing sufficient flexibility allowing said first strap to fold and by holding open in common with said second strap and third strap intermittently forming a temporary unrestricted vertical passage through which said body board is inserted to a position approximately central to said cradle, wherein said cradle vertically encircles the said board; wherein said first strap further is selectively displaced to rest in a horizontal position and be positioned laterally circumscribing said board;

and said first, second, and third straps in concert with each other being capable of being tightened to grip said board and a user when said third strap is supported vertically on a shoulder of a user.

2. A strap and carry system according to claim 1, characterized in that said object includes skim boards, snow boards, beach chairs, lawn chairs, and skate boards.

3. A strap and carry system according to claim 1, characterized in that said ring provides permanently fixed connections.

4. A strap and carry system according to claim 1, characterized in that said second strap is provided with additional strap material of sufficient length and being adapted to pass through said second adjustable detachable fastening means wherein said strap material can be pulled by user for reducing the size said cradle thereby tightening said second strap, third strap, and ring thereby gripping an object placed within said cradle.

5. A strap and carry system according to claim 1, in which said ring is a flexible rope ring.

6. A strap and carry system according to claim 1, in which said first, second and third straps include a plastic webbing material.

7. A strap and carry system according to claim 1, in which said first and second adjustable and detachable means include adjustable buckles.

8. A strap and carry system according to claim 1, in which said strap and carry system is foldable to approximately pocket size when not in use.

* * * * *